US007898476B2

(12) United States Patent
Nichols et al.

(10) Patent No.: US 7,898,476 B2
(45) Date of Patent: Mar. 1, 2011

(54) METHOD AND SYSTEM FOR CONTROLLING THE DIRECTION OF AN ANTENNA BEAM

(75) Inventors: Richard W. Nichols, Manhattan Beach, CA (US); Gilbert M. Shows, Plano, TX (US); Joel C. Roper, Plano, TX (US)

(73) Assignee: Raytheon Company, Waltham, MA (US)

( * ) Notice: Subject to any disclaimer, the term of this patent is extended or adjusted under 35 U.S.C. 154(b) by 134 days.

(21) Appl. No.: 12/017,916

(22) Filed: Jan. 22, 2008

(65) Prior Publication Data

US 2008/0258971 A1 Oct. 23, 2008

Related U.S. Application Data

(60) Provisional application No. 60/886,024, filed on Jan. 22, 2007.

(51) Int. Cl.
*H01Q 3/00* (2006.01)

(52) U.S. Cl. ..... 342/359; 342/367; 342/420

(58) Field of Classification Search ..... 342/359, 342/367, 420

See application file for complete search history.

(56) References Cited

U.S. PATENT DOCUMENTS

| | | | | |
|---|---|---|---|---|
| 5,258,764 | A | 11/1993 | Malinowski | 342/359 |
| 5,587,714 | A | 12/1996 | Chu et al. | 342/354 |
| 5,854,609 | A | 12/1998 | Pyo et al. | 342/359 |
| 6,023,242 | A | 2/2000 | Dixon | |
| 6,034,643 | A | 3/2000 | Nishikawa et al. | 343/765 |
| 2001/0003443 | A1 * | 6/2001 | Velazquez et al. | 342/367 |
| 2006/0100777 | A1 * | 5/2006 | Staton et al. | 701/208 |
| 2006/0292981 | A1 * | 12/2006 | Fall et al. | 455/12.1 |

FOREIGN PATENT DOCUMENTS

| | | | |
|---|---|---|---|
| EP | 1 610 145 | A1 | 12/2005 |
| EP | 1 739 449 | A1 | 3/2007 |

OTHER PUBLICATIONS

Chelton, Inc., "IGA-3000 Intermediate Gain Antenna" brochure, www.cheltonsatcom.com; 2 pages.

PCT Notification of Transmittal of the International Search Report and the Written Opinion of the International Searching Authority, or the Declaration, mailed Oct. 16, 2008, in re PCT/US 2008/051614 filed Jan. 22, 2008 (12 pages), Oct. 16, 2008.

* cited by examiner

*Primary Examiner*—Thomas H Tarcza
*Assistant Examiner*—Fred H Mull
(74) *Attorney, Agent, or Firm*—Baker Botts L.L.P.

(57) ABSTRACT

In one embodiment, a system for controlling the direction of an antenna beam includes a location identifier, an orientation sensor, and an antenna beam controller. The location identifier determines a transmit antenna location indicating the location of a transmit antenna, where the transmit antenna produces an antenna beam. The orientation sensor determines a transmit antenna orientation indicating the orientation of the transmit antenna. The antenna beam: accesses target data describing a receive antenna of a target, the target data comprising a location of the receive antenna relative to the transmit antenna; calculates a deviation value from the transmit antenna location, the transmit antenna orientation, and the target data; and adjusts the direction of the antenna beam to reduce the deviation value.

23 Claims, 3 Drawing Sheets

METHOD AND SYSTEM FOR CONTROLLING THE DIRECTION OF AN ANTENNA BEAM

RELATED APPLICATIONS

This application claims priority to U.S. Provisional Patent Application Ser. No. 60/886,024, entitled "BEAM CONTROL SYSTEM FOR AN ANTENNA," which was filed on Jan. 22, 2007.

TECHNICAL FIELD OF THE DISCLOSURE

This disclosure relates generally to antenna systems, and more particularly to a method and system for controlling the direction of an antenna beam.

BACKGROUND OF THE DISCLOSURE

Wireless communication involves transmission of signals between transceivers. A transceiver points its antenna beam in the proper direction in order to effectively communicate with another transceiver. In some cases, transceivers may move with respect to each other.

SUMMARY OF THE DISCLOSURE

In one embodiment, a system for controlling the direction of an antenna beam includes a location identifier, an orientation sensor, and an antenna beam controller. The location identifier determines a transmit antenna location indicating the location of a transmit antenna, where the transmit antenna produces an antenna beam. The orientation sensor determines a transmit antenna orientation indicating the orientation of the transmit antenna. The antenna beam: accesses target data describing a receive antenna of a target, the target data comprising a location of the receive antenna relative to the transmit antenna; calculates a deviation value from the transmit antenna location, the transmit antenna orientation, and the target data; and adjusts the direction of the antenna beam to reduce the deviation value.

Particular embodiments of the present disclosure may exhibit some, none, or all of the following technical advantages. For example, an advantage of one embodiment may be that a beam control system may include a location identifier and an orientation sensor that provide the location and orientation of an antenna that may be moving with respect to a target. The antenna location and orientation may be compared with target data to track the target.

Other technical advantages will be readily apparent to one skilled in the art from the following figures, description, and claims.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Figure 1:
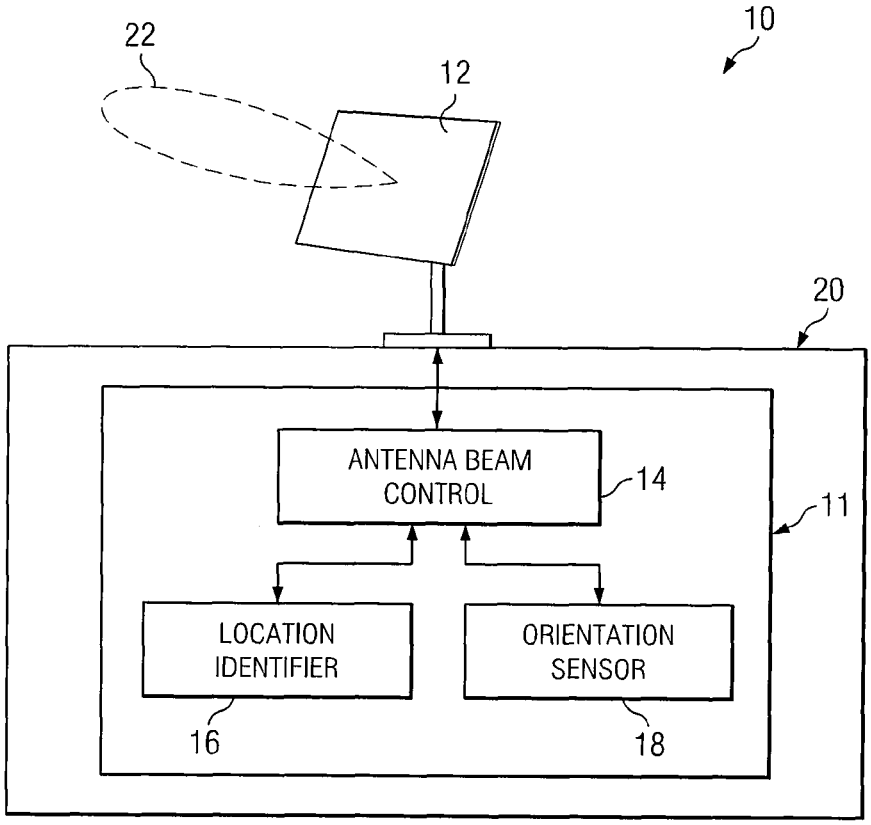
FIG. 1 is a block diagram showing one embodiment of a beam control system according to the teachings of the present disclosure.

FIG. 1 is a block diagram showing one embodiment of a beam control system 10 for an antenna 12. Beam control system 10 may include a location identifier and an orientation sensor that provide the location and orientation of an antenna that may be moving with respect to a target. The antenna location and orientation may be compared with target data to track the target.

In one embodiment, a path between transmit antenna 12 and a receive antenna allows energy from antenna 12 to reach the receive antenna. In the embodiment, system 10 determines the attitude and location of antenna 12, and uses the antenna attitude and location to define the perpendicular to the radiating surface of antenna 12. System 10 uses the perpendicular and the location of the receive antenna to direct the antenna beam of antenna 12 in the direction of the receive antenna.

In the illustrated example, beam control system 10 includes a housing 11 that houses an antenna beam controller 14 coupled to a location identifier 16, an orientation sensor 18, and antenna 12 as shown. Antenna 12 is mounted to a structure 20, which may be moving or stationary. In this description, movement, location, and orientation of an object may be with any suitable frame of reference, such as the reference frame of the Earth. For example, an object may be considered stationary or moving with respect to any suitable reference frame. In this description, orientation may be given by azimuth and elevational angles.

Antenna 12 generates a beam 22 for communication with a target. A target may represent any suitable entity that can communicate signals to and/or from antenna 12. Examples of a target include an orbiting satellite or a ground-based communication station. Antenna 12 may move or may be stationary with respect to the target. For example, antenna 12 and a target may stationary with respect to each other, antenna 12 may move with respect to a stationary target, a target may move with respect to a stationary antenna 12, or both antenna 12 and a target may move.

Housing 11 represents a substantially rigid or flexible housing that houses antenna beam controller 14, location identifier 16, and/or orientation sensor 18. In one embodiment, location identifier 16 and orientation sensor 18 are integrated into housing 11. Location identifier 16 provides an antenna location indicating the location of antenna 12. In one embodiment, location identifier 16 comprises a Global Positioning System (GPS) receiver that communicates with a GPS satellite to determine location. In another embodiment, location identifier 16 comprises an Inertial Measurement Unit (IMU) that senses its own rate and direction of motion to track its position.

Orientation sensor 18 determines the orientation of antenna 12. Orientation sensor 18 may include a north finding module and an attitude sensor. The north finding module locates the due North direction. The attitude sensor detects orientation. For example, the attitude sensor may include gyroscopes that detect changes in orientation. The north finding module and the attitude sensor may be used to determine the orientation of antenna 12 with reference to due North.

In one example, antenna 12 moves with structure 20. Accordingly, the location and/or orientation of structure 20 indicates the location and/or orientation of antenna 12. In the example, location identifier 16 may determine the location of structure 20 to provide the antenna location. Orientation sensor 18 may determine the orientation of structure 20 to determine the antenna orientation of antenna 12.

Antenna beam controller 14 adjusts the direction of beam 22 generated by antenna 12. In one embodiment, antenna beam controller 14 compares the antenna location and orientation with target data to derive a deviation value, and adjusts the direction of beam 22 to reduce the deviation value.

In the embodiment, antenna beam controller 14 receives the antenna location from location identifier 16 and the antenna orientation from orientation sensor 18. The target data may describe a location of the receive antenna relative to the transmit antenna. The target data includes mappings. A mapping maps a location to a target position that an antenna at the location can use to communicate with the target. For example, the antenna may direct a beam in the direction given by the target position.

In the embodiment, the deviation value may be calculated from the antenna orientation and the target position. If the antenna orientation and the target position are with respect to the same reference frame, the deviation value may be the difference between the orientation. Otherwise, one or both orientations may be converted to the same reference frame, and a difference may then be taken.

Acceptable deviation values may be determined according to the factors of the antenna system, such as the signal and geometry of the antenna. In one example, the target is a geosynchronous satellite operating in the L-band (approximately 1 to 2 Giga-Hertz). Given this frequency range, the direction of beam 22 may be satisfactorily controlled by maintaining a deviation value consistent with the link margin of the system. For L-band systems, an acceptable deviation value may be as large as approximately 10 degrees.

Antenna beam controller 14 adjusts the direction of beam 22 in any suitable manner. For example, antenna beam controller 14 may physically and/or electronically steer beam 22.

In one embodiment, antenna beam controller 14 may be coupled to location identifier 16 and orientation sensor 18 using any suitable link, such as a digital communication link, for example, a RS-422 serial data link. According to another embodiment, location identifier 16 and/or orientation sensor 18 may be integrated within antenna beam controller 14 and coupled to antenna beam controller 14 through an internal system bus.

Structure 20 may represent a moving and/or stationary object. Examples of structure 20 include an automobile, an aircraft, or a watercraft.

A component of system 10 may include an interface, logic, memory, and/or other suitable element. An interface receives input, sends output, processes the input and/or output, and/or performs other suitable operation. An interface may comprise hardware and/or software.

Logic performs the operations of the component, for example, executes instructions to generate output from input. Logic may include hardware, software, and/or other logic. Logic may be encoded in one or more tangible media and may perform operations when executed by a computer. Certain logic, such as a processor, may manage the operation of a component. Examples of a processor include one or more computers, one or more microprocessors, one or more applications, and/or other logic.

A memory stores information. A memory may comprise one or more tangible, computer-readable, and/or computer-executable storage medium. Examples of memory include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Figure 2:
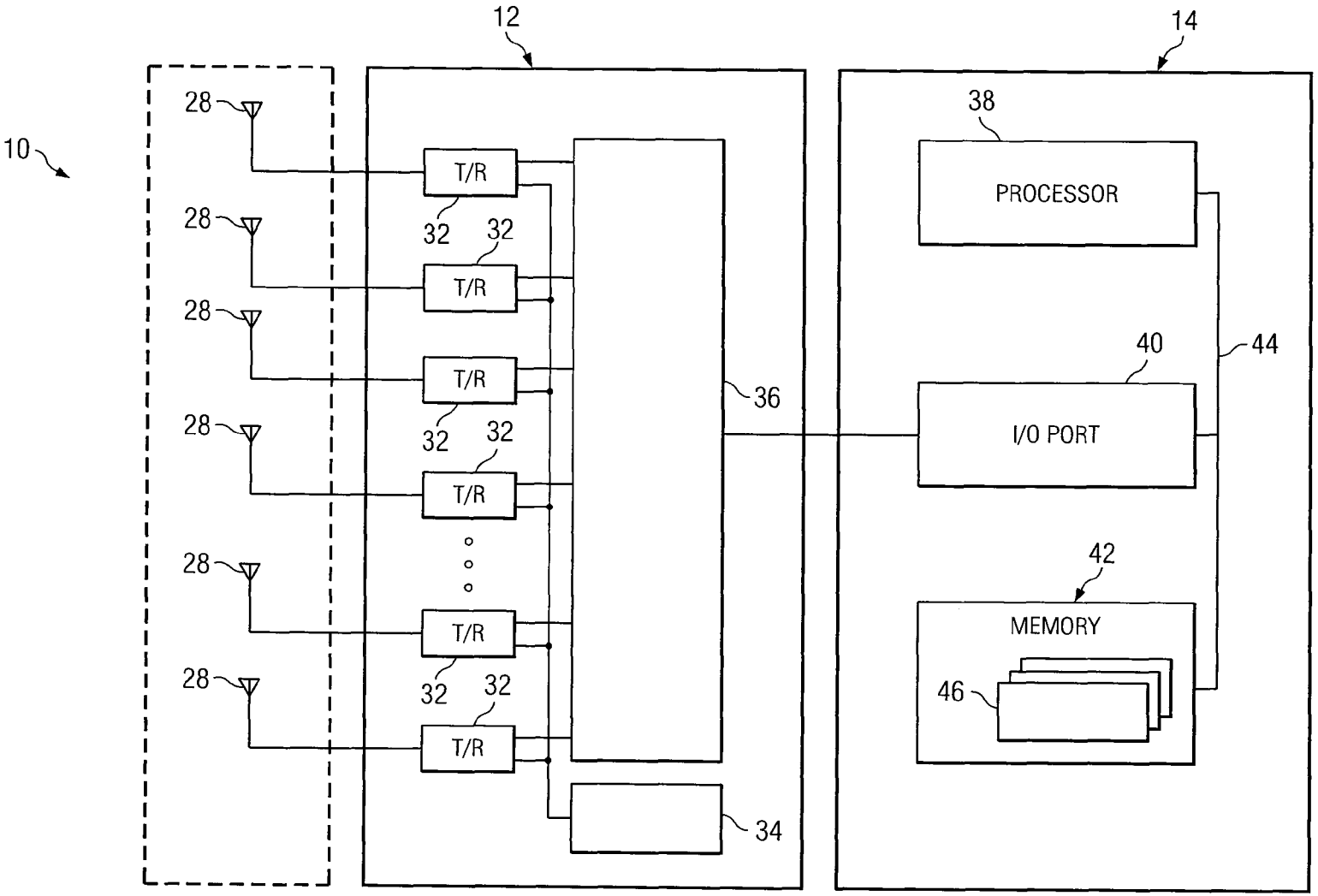
FIG. 2 is a block diagram showing one embodiment of the antenna beam controller and the antenna of FIG. 1.

FIG. 2 is a block diagram showing one embodiment of system 10 of FIG. 1 in which antenna beam controller 14 is coupled to an active electronically scanned array (AESA) antenna 12. AESA antenna 12 includes a number of radiating elements 28, a number of transmit/receive modules 32, a signal distribution circuit 34, and a control circuit 36 coupled as shown. A radiating element 28 may be a horizontal, vertical, or general (horizontal and vertical) radiating element.

Signal distribution circuit 34 distributes signals to radiating elements 28 via transmit/receive modules 32. Control circuit 36 controls the amplitude and phase of signals transmitted and/or received by radiating element 28 to electronically steer the direction of beam 22.

Antenna beam controller 14 comprises a computer processor 38, an input/output port 40, and a memory 42 coupled through a system bus 44 as shown. Computer processor 38 executes instructions stored in memory 42. Input/output port 40 may be coupled to control circuit 36 using any suitable protocol, such as an RS-422 serial communication protocol.

Memory 26 stores target data 46. Target data 46 includes mappings. A mapping maps a location to a target position that an antenna at the location can use to communicate with the target.

Figure 3:
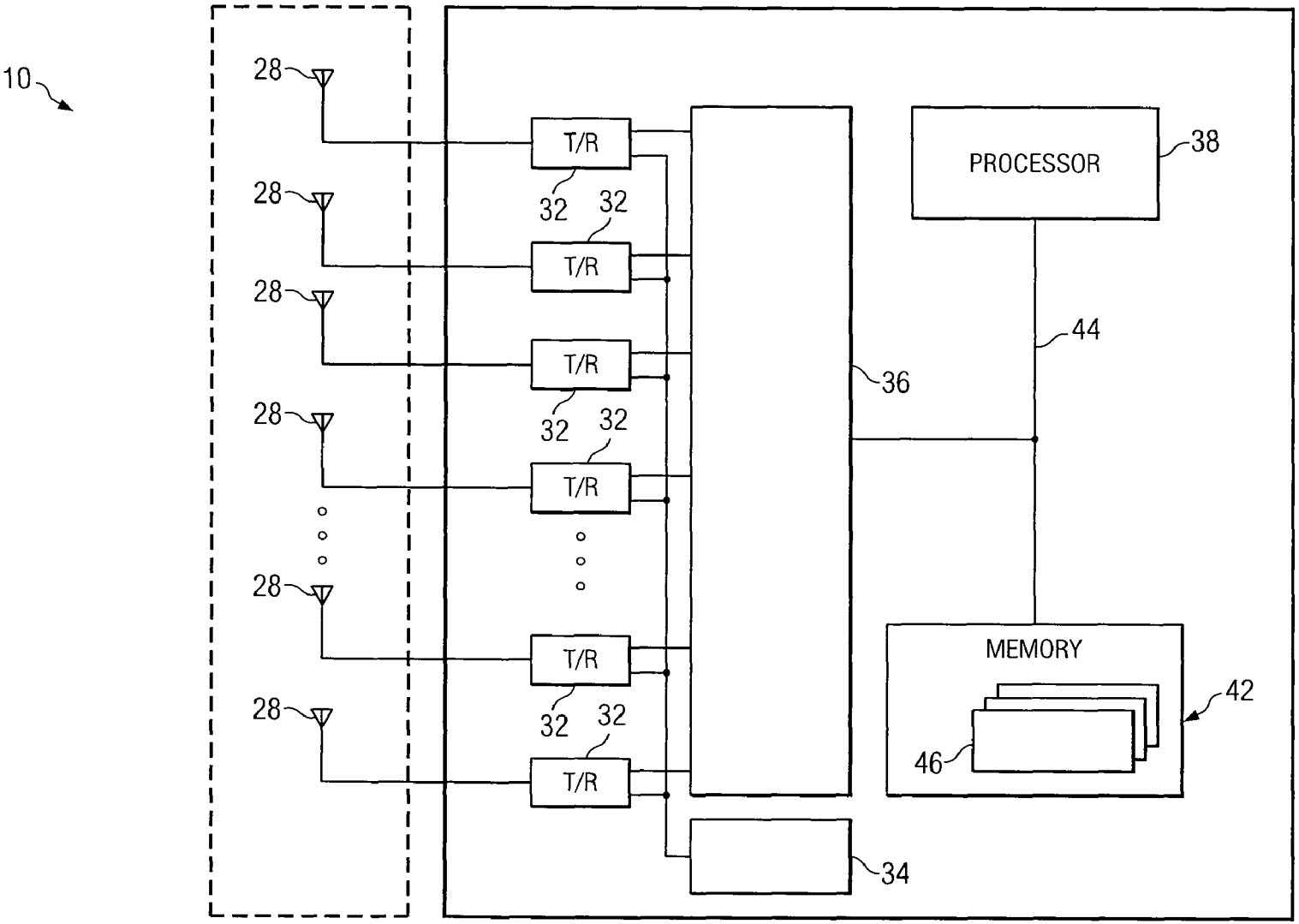
FIG. 3 is a block diagram showing another embodiment of the antenna beam controller and the antenna of FIG. 1.

FIG. 3 is a block diagram showing another embodiment of system 10 of FIG. 1. In the embodiment, control port 36 is coupled directly to system bus 44. Control port 36 receives control signals from computer processor 38 and distributes the control signals to each transmit/receive module 32 for electronically adjusting the direction of beam 22 relative to structure 20 or to antenna 12.

Modifications, additions, or omissions may be made to beam control system 10 without departing from the scope of the disclosure. Moreover, beam control system 10 may comprise more, fewer, or other elements. For example, orientation sensor 18 may include other components, such as magnetometers. As used in this document, "each" refers to each member of a set or each member of a subset of a set.

Figure 4:
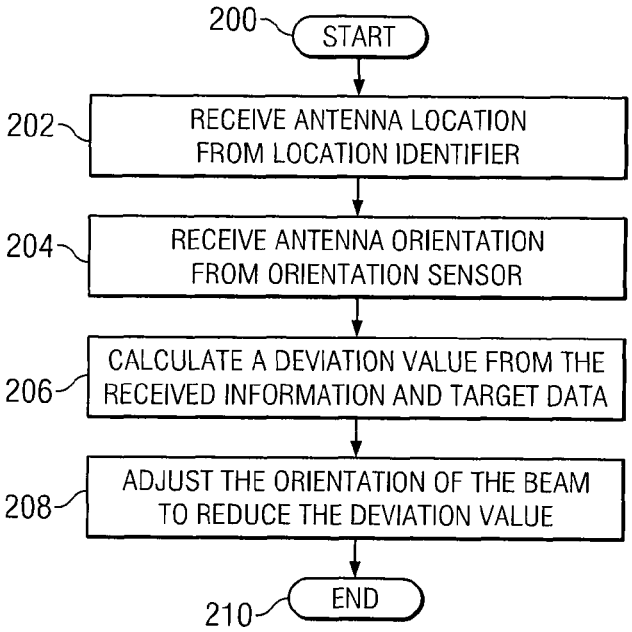
FIG. 4 is a flowchart showing one embodiment of a method that may be taken by the antenna beam controller of FIG. 1.

FIG. 4 is a flowchart showing one embodiment of a method that may be performed by beam control system 10 to control the direction of beam 22 relative to structure 20. The method starts at step 200. At step 202, beam control system 10 receives the antenna location from location identifier 16. At step 204, beam control system 10 receives the antenna orientation from orientation sensor 18.

At step 206, beam control system 10 calculates a deviation value from the antenna information and the target data. In one embodiment, the target position is determined from a mapping of the antenna location to the target position. The deviation value is then calculated from the difference between the target and antenna orientations.

Beam control system 10 adjusts the direction of beam 22 according to the deviation value at step 208. Beam control system 10 may physically or electronically steer beam 22. Steps 202 through 208 may be repeated during operation of beam control system 10 in order to point beam 22 towards the target. The methods ends at step 210.

Modifications, additions, or omissions may be made to the method without departing from the scope of the disclosure. The method may include more, fewer, or other steps. For example, the method described directs beam 22 towards an orbiting satellite. In other embodiments, beam control system 10 may direct beam 22 towards a stationary antenna mounted on Earth.

Particular embodiments of the present disclosure may exhibit some, none, or all of the following technical advantages. For example, an advantage of one embodiment may be that a beam control system may include a location identifier and an orientation sensor that provide the location and orientation of an antenna that may be moving with respect to a target. The antenna location and orientation may be compared with target data to track the target.

Although the present disclosure has been described in several embodiments, a myriad of changes, variations, alterations, transformations, and modifications may be suggested to one skilled in the art, and it is intended that the present disclosure encompass such changes, variations, alterations, transformations, and modifications as falling within the spirit and scope of the appended claims.

What is claimed is:

1. A system for controlling the direction of an antenna beam, the system comprising:

a housing coupled to a vehicle;

an integrated Global Positioning System (GPS) receiver located in the housing, configured to determine a transmit antenna location indicating the location of a transmit antenna, the transmit antenna being coupled to the housing and configured to produce an antenna beam;

an orientation sensor located in the housing configured to determine a transmit antenna orientation indicating the orientation of the transmit antenna; and an antenna beam controller located in the housing configured to:

access target data describing a receive antenna of a target, the target data comprising a location of the receive antenna relative to the transmit antenna;

calculate a deviation value by:

determining a difference between the transmit antenna location and at least a portion of the target data; and determining a difference between the transmit antenna orientation and at least a portion of the target data;

wherein the deviation value quantifies a difference between a target direction and an actual direction of the antenna beam produced by the transmit antenna, the target direction intersecting the location of the receive antenna relative to the transmit antenna, and the target direction being different from the actual direction of the antenna beam produced by the transmit antenna; and adjust the actual direction of the antenna beam to reduce the deviation value.

2. The system of claim 1, the antenna beam controller further configured to calculate the deviation value by:

accessing the target data comprising a mapping that maps the transmit antenna location to a target position; and determining the target position from the transmit antenna location and the mapping.

3. The system of claim 1, the antenna beam controller further configured to:

determine whether the deviation value exceeds a predetermined threshold; and based at least in part on a determination that the deviation value exceeds the predetermined threshold, adjust the actual direction of the antenna beam until the beam controller determines that the deviation value is less than or equal to the predetermined threshold.

4. The system of claim 1, the antenna beam controller comprising an input/output port configured to communicate with a control circuit of the transmit antenna according to a serial communication protocol.

5. The system of claim 1, the antenna beam controller comprising a system bus configured to communicate with a control circuit of the antenna.

6. The system of claim 1, the target comprising an orbiting satellite.

7. The system of claim 1, the target comprising a ground-based antenna.

8. The system of claim 1, the orientation sensor comprising a north finding module configured to determine a due North heading.

9. The system of claim 1, the orientation sensor comprising an attitude sensor configured to determine the orientation of the transmit antenna.

10. The system of claim 1, the vehicle comprising a watercraft.

11. A method for controlling the direction of an antenna beam, the method comprising:

determining, by an integrated Global Positioning System (GPS) receiver located in a housing coupled to a vehicle, a transmit antenna location indicating the location of a transmit antenna, the transmit antenna being coupled to the housing and configured to produce a beam;

determining, by an orientation sensor located in the housing, a transmit antenna orientation indicating the orientation of the transmit antenna;

accessing target data, by an antenna beam controller located in the housing, describing a receive antenna of a target, the target data comprising a location of the receive antenna relative to the transmit antenna;

calculating, by the antenna beam controller, a deviation value by:

determining a difference between the transmit antenna location and at least a portion of the target data; and determining a difference between the transmit antenna orientation and at least a portion of the target data;

wherein the deviation value quantifies a difference between a target direction and an actual direction of the antenna beam produced by the transmit antenna, the target direction intersecting the location of the receive antenna relative to the transmit antenna, and the target direction being different from the actual direction of the antenna beam produced by the transmit antenna; and adjusting the actual direction of the beam, by the antenna beam controller, to reduce the deviation value.

12. The method of claim 11, the calculating the deviation value further comprising:

accessing the target data comprising a mapping that maps the transmit antenna location to a target position; and determining the target position from the transmit antenna location and the mapping.

13. The method of claim 11, the calculating the deviation value further comprising:

determining whether the deviation value exceeds a predetermined threshold; and based at least in part on a determination that the deviation value exceeds the predetermined threshold, adjusting the actual direction of the antenna beam until the beam controller determines that the deviation value is less than or equal to the predetermined threshold.

14. The method of claim 11, further comprising:

communicating, through an input/output port, with a control circuit of the transmit antenna according to a serial communication protocol.

15. The method of claim 11, further comprising:

communicating with a control circuit of the transmit antenna though a system bus.

16. The method of claim 11, the target comprising an orbiting satellite.

17. The method of claim 11, the target comprising a ground-based antenna.

18. The method of claim 11, further comprising:

determining a due North heading.

19. The method of claim 11, further comprising:

determining the orientation of the transmit antenna using an attitude sensor.

20. The method of claim 11, the vehicle comprising a watercraft.

21. A system for controlling the direction of an antenna beam, the system comprising:

a housing coupled to a vehicle;

an integrated Global Positioning System (GPS) receiver located in the housing configured to determine a transmit antenna location indicating the location of a transmit antenna, the transmit antenna being coupled to the housing and configured to produce a beam, the transmit antenna moving with respect to a target;

an orientation sensor located in the housing configured to determine a transmit orientation indicating the orientation of the transmit antenna; and an antenna beam controller located in the housing, wherein the antenna beam controller is configured to:

access target data describing a receive antenna of a target, the target data comprising a location of the receive antenna relative to the transmit antenna;

calculate a deviation value by:

determining a difference between the transmit antenna location and at least a portion of the target data; and determining a difference between the transmit antenna orientation and at least a portion of the target data;

wherein the deviation value quantifies a difference between a target direction and an actual direction of the antenna beam produced by the transmit antenna, the target direction intersecting the location of the receive antenna relative to the transmit antenna, and the target direction being different from the actual direction of the antenna beam produced by the transmit antenna; and adjust the actual direction of the beam to reduce the deviation value.

22. The system of claim 21, the antenna beam controller further configured to calculate the deviation value by:

accessing the target data comprising a mapping that maps the transmit antenna location to a target position;

determining the target position from the transmit antenna location and the mapping;

determining a difference between the location orientation and the target position; and calculating the deviation value according to the difference.

23. The system of claim 21, the antenna beam controller further configured to:

determine whether the deviation value exceeds a predetermined threshold; and based at least in part on a determination that the deviation value exceeds the predetermined threshold, adjust the actual direction of the antenna beam until the beam controller determines that the deviation value is less than or equal to the predetermined threshold.

* * * * *